US006769157B1

(12) United States Patent
Meal

(10) Patent No.: US 6,769,157 B1
(45) Date of Patent: Aug. 3, 2004

(54) SAFETY GUARD FOR SEAT BELT BUCKLE RELEASE

(76) Inventor: Patricia L. Meal, 4547 Pine Tree Dr., St. Cloud, FL (US) 34772

( * ) Notice: Subject to any disclaimer, the term of this patent is extended or adjusted under 35 U.S.C. 154(b) by 0 days.

(21) Appl. No.: 10/423,152

(22) Filed: Apr. 24, 2003

(51) Int. Cl.[7] ..... A44B 11/26; A41F 1/00

(52) U.S. Cl. ..... 24/633; 24/173; 24/437; 24/573.1; 24/579.11; 24/634; 70/55; 70/63; 220/284; 297/468

(58) Field of Search ..... 24/633, 573, 574, 24/487, 657, 437, 173, 636, 634, 637, 579.11, 573.1; 297/468; 220/284; 70/55, 56, 63

(56) References Cited

U.S. PATENT DOCUMENTS 3,484,908 A * 12/1969 Lamb ..... 24/579.11
4,502,194 A * 3/1985 Morris et al. ..... 24/633
4,540,218 A * 9/1985 Thomas ..... 297/468
4,675,954 A * 6/1987 Gullickson ..... 24/633
4,731,912 A * 3/1988 Boriskie et al. ..... 24/633
4,878,277 A * 11/1989 Portuese ..... 24/633
4,961,251 A * 10/1990 Smith ..... 24/633
5,442,840 A * 8/1995 Ewald ..... 24/633
5,617,617 A * 4/1997 Gustin ..... 24/633

* cited by examiner

*Primary Examiner*—Victor Sakran
(74) *Attorney, Agent, or Firm*—Donald W. Meeker

(57) ABSTRACT

A seat belt buckle guard device is provided for preventing access to a release button on a seat belt. The device comprises a sleeve structured to fit over a variety of shapes and sizes of seat belt buckles. The sleeve comprises a front face and a top face that are capable of covering the front portion of a variety of seat belt buckles. The sleeve is made of sufficiently rigid material to prevent indentation of the faces and thereby prevent contact with both front and top belt buckle release button. The sleeve further comprising a split back face, which enables the sleeve to expand to fit over the variety of seat belt buckles. A top arm extending from the sleeve engages the seat belt strap with a tight friction fit to resist removal of the sleeve.

5 Claims, 1 Drawing Sheet

SAFETY GUARD FOR SEAT BELT BUCKLE RELEASE

BACKGROUND OF THE INVENTION

1. Field of the Invention

The present invention relates to vehicle seat belts and in particular to a safety guard for covering a seat belt buckle release to prevent accidental opening of the safety belt.

2. Description of the Prior Art

The release buttons for vehicle seat belts are often openly accessible on the surface of the seat belt buckles. Accidental contact of the release button opens the seat belt buckle and renders the seat belt useless in case of an accident or sudden stop. Children are prone to playing with things and also intentionally doing what they are told not to do. They can easily release a seat belt in play endangering their own lives or the lives of siblings or others in the vehicle including toddlers or infants in child safety seats to which the seat belt is secured.

With a seat belt opened in an accident or sudden stop a person can be thrown around in the vehicle resulting in injury or death, which would not otherwise occur if the seat belt had remained securely fastened.

Seat belts, or safety restraints, have been standard equipment on passenger vehicles for more than a generation. Under Federal law, children up to age two must now be restrained in an acceptable safety seat during any vehicular travel. Some states have extended mandatory seat belt wearing for children up to four, five, six or even nine years of age. In still other states, safety belts must now be worn by every driver and passenger regardless of age. The rationale for such laws has been repeatedly proven by statistics, namely that safety belts save lives. Safety belts are only effective at preventing injury and death as long as they remain engaged or fastened, however.

When travelling by car, most young children cannot avoid being drawn to the colorful belt and often shiny metallic buckle engaged around their waists, or around the safety seats in which they ride. For some safety seat designs, the belt buckle release mechanism is within easy reach of the child/occupant. So often, a child's hands naturally rest on or about the safety belt buckle assembly. Such hands will quickly learn how to disengage most any belt buckle without ever once witnessing another perform the same task.

Although children as old as one or two have sufficient strength and dexterity to operate the release mechanisms of most vehicular safety belts, they are not old enough to appreciate the importance of remaining fastened at all times. Motor vehicle accidents are the leading cause of death and crippling injury for young children in this country. As many as 700 children under five die each year from injuries sustained as motor vehicle passengers. Adults cannot always maintain constant supervision over their young passengers to assure that they remained fastened in appropriate safety restraints. To do so would be a greater distraction to drivers causing even more accidents, injuries and deaths. Hence, there exists a clear need for preventing babies, toddlers and other young children from unfastening or unbuckling themselves from such safety devices.

With any safety belt cover or guard design, there is no need to raise concerns about the operation of hidden or tricky release mechanisms by emergency medical personnel. In an accident or other emergency, paramedics are now trained to cut away safety belts rather than to waste time unfastening safety restraints of various sorts.

U.S. Pat. No. 3,484,908, issued Dec. 23, 1969 to Lamb, discloses a cover member for use with a safety belt of the type that has a quick release lever, which when lifted outwardly from the body serves to separate the male insert from the locked engagement in the female receptacle. The cover member is designed to slidably engage and surround the female receptacle so when it is in position, it is impossible to accidentally operate the quick release lever.

U.S. Pat. No. 4,675,954, issued Jul. 30 1987 to Gullickson, describes a cover for a control mechanism. Activation of the control with the cover in place requires more strength than a child has; thus a child cannot, as a rule, activate the control. Concurrently, activation of the control with the cover in place does not require more strength than an adult has, so an adult can activate the control. The cover may be used over a release control on a seat belt buckle. The portion of the cover overlying the control is generally deflectable, so that an adult may activate the control through the cover. Regarding deflectability of the cover, it is rigid and stiff enough that a child may not deflect it enough to activate the control, while being simultaneously sufficiently flexible and resilient that the control may be activated by an adult by deflection of the cover.

U.S. Pat. No. 4,624,033, issued Nov. 25, 1986 to Orton, illustrates a child safety seat belt securement device that includes a housing adapted for at least partially covering the release button of a female seat belt buckle so that direct access to the release button is substantially restricted. The housing includes a mechanism for releasably securing it onto a conventional female seat belt buckle. Finally, the housing includes an actuator mechanism that is actuatable by an adult for depressing the release button of the female seat belt buckle on which the housing is secured. The same actuator mechanism is difficult, if not impossible, for a young child to operate, however, due to its complicated or multi-step operation or the force required for actuating it.

U.S. Pat. No. 5,442,840, issued Aug. 22, 1995 to Ewald, concerns a seat belt buckle safety sheath, which prevents the inadvertent releasing of the seat belt buckle by young children. Specifically, the seat belt buckle safety sheath is made of a resilient material and frictionally encompasses the female portion of the seat belt buckle. The resilient material of the safety sheath imposes a compressive force substantially greater than the normal force required to release the seat belt buckle from a fastened condition. Thus, an adult can compress the resilient material to activate the seat belt buckle release button, while a child will be prevented from accomplishing same.

U.S. Pat. No. 4,502,194, issued Mar. 5, 1985 to Morris, indicates an automobile seat belt that includes a latch tongue fixed to one belt segment and has a latching aperture, and a latch housing fixed to the other belt segment. The device also has a recess and opening at its distal end to receive the latch tongue. The tongue is automatically latched within the housing by insertion; and the tongue is released by depressing a release button through an opening in the top face of the latch housing. To render the seat belt child proof, one form of safety cover is a sleeve slipped over the latch housing, the sleeve having one end partially closed to pass the latch tongue and the sleeve having a limited access opening in one face to overlie the release button. The sleeve is retained in enclosing position on the housing by the latch tongue. The limited access opening may be a small opening only large enough to pass the tip of the ignition key to depress the release button and unfasten the belt. The limited access opening may be larger with the housing having means for retaining a child proof safety cap of the type employed for prescription and non-prescription drugs. Another form of safety cover is a band encircling the housing and enclosing the release button opening and secured to the housing in a semi-permanent manner by an adhesive. The band has a limited access opening overlying the release button, and the band itself may be sufficiently stiff to prevent depressing the button through the band, or a stiff aperture plate configured to overlie the release button and adjacent housing may be secured by means of the band. The band may be secured to the housing by a releasable fastening system other than an adhesive cement.

U.S. Pat. 4,939,824, issued Jul. 10, 1990 to Reed, claims a cover for vehicle safety belt buckles for preventing opening of a vehicle safety belt by young children or the like. The cover comprises a covering member for covering the buckle and for preventing or rendering more difficult the operation of belt releasing means on the buckle, and means for releasably securing the cover to the safety belt. The cover of the present invention can be easily installed on or removed from a vehicle safety belt by an adult, and when installed, will substantially prevent a young child from intentionally or accidentally opening the safety belt.

U.S. Pat. No. 4,961,251, issued Oct. 9, 1990 to Smith, is for a safety belt buckle guard that comprises a flexible body of fabric adapted to wrap around an engaged belt buckle assembly, a rigid member for preventing depression of the release mechanism on said belt buckle assembly, means for positioning the rigid member adjacent the flexible body or attaching it thereto, and means for connecting the flexible body to itself after it is wrapped an engaged belt buckle assembly. Preferred embodiments include connecting means consisting essentially of a pair of hook and loop fastener, or Velcro, strips attached to the flexible body interior and exterior along opposite edges of said flexible body.

U.S. Pat. No. 4,674,303, issued Jun. 23, 1987 to Salcone, II, discloses a safety lock for a seat belt buckle that includes a housing for receiving and containing the seat belt buckle therein and a locking portion for releasably retaining the housing in a closed position wherein the buckle is substantially enclosed therein. When the safety lock is assembled in the closed position on a seat belt buckle and the buckle is utilized for detachably interconnecting first and second seat belt sections, the safety lock restricts access to the buckle in a manner which normally prevents a small child from disconnecting the seat belt sections but nevertheless permits the seat belt sections to be easily disconnected by an adult.

U.S. Pat. No. 4,731,912, issued Mar. 22, 1988 to Borislie, provides a seat belt buckle release guard apparatus that has a box like device, which includes first and second portions that have recessed opposing ends and sides that are shelf hinged on one side, and bear a latch on a side opposing the hinged side. When the first and second portions are closed, opposing end apertures are formed for receiving a seat belt buckle segment and a tongue segment with the buckle sandwiched between the first and second portions. In one embodiment the latch bearing first portion side is recessed and a latching lug is formed within the recess; the latch bearing second portion side includes a latch for engaging the lug to close the box like device. When closed the recess forms a guide to the latch. The bottom of the recess is thickened to stiffen the latch bearing side and to position the seat belt buckle in the box like device. In operation the recess thickened bottom coacts with the box like device sides and seat belt buckle to rigidify the box and enhance the latching strength of the latch thereby making it difficult for a child to open the box like device and push the seat belt release button.

What is needed is an inexpensive and easy-to-apply means to cover or guard the seat belt release button to prevent accidental or willful release of a seat belt while a vehicle is in motion.

SUMMARY OF THE INVENTION

An object of the present invention is to provide a cover or guard the seat belt release button to prevent accidental or willful release of a seat belt while a vehicle is in motion.

Another object of the present invention is to provide a seat belt cover or guard that is easy to install, thereby to encouraging vehicle owners to use the device.

One more object of the present invention is to provide a cover or guard that is structured to fit over a wide variety of types of seat belt buckles.

A further object of the present invention is to provide a seat belt cover or guard that is inexpensive and easy to manufacture in mass production by a molding process, providing wide distribution and widespread use, thereby saving lives and preventing injury.

An additional object of the present invention it to keep children in their seat belts to prevent excessive movement in a moving motor vehicle.

A further object of the present invention is to provide a device that will lower the cost to vehicle insurance companies, and in turn to vehicle owners.

In brief, a seat belt buckle guard device for preventing access to a release button on a seat belt. The device comprises a sleeve structured to fit over a variety of shapes and sizes of seat belt buckles. The sleeve comprises a front face capable of covering a front portion of each of the variety of seat belt buckles and a top face angled inwardly from the front face. The top face is capable of covering a top portion of each of the variety of seat belt buckles. Both the top and front faces are formed of sufficiently rigid material to prevent indentation faces and thereby prevent contact with a front seat belt buckle release button. The sleeve further comprising a split back face connected to the front face by two side faces. The split back face enables the sleeve to expand to fit over the variety of seat belt buckles. The sleeve further comprises a bottom opening that is capable of fitting over a receiving end of the seat belt buckle, and a top arm extending from the sleeve.

The top arm is capable of fitting between an insertion portion of the seat belt buckle and a seat belt strap attached to the insertion portion. The top arm is also capable of being lodged between the insertion portion and the seat belt strap to secure the sleeve in place. The arm comprises a hook extending from a side of a top end of the sleeve and spaced apart from the sleeve a sufficient distance to accommodate a seat belt strap between the arm and the sleeve. The arm is sufficiently thick to fit between the insertion portion of the seat belt buckle and the seat belt strap with a tight friction fit. The arm also has at least one arm portion capable of engaging a slot in the insertion portion of the seat belt buckle through which slot the seat belt strap is engaged.

An advantage of the present invention is that it protects against release of the seat belt.

Another advantage of the present invention is that it is simple to engage.

An additional advantage of the present invention is that it is inexpensive and easy to manufacture.

One more advantage of the present invention is that it keeps children in their seat belts.

A further advantage of the present invention is to provide a device that will lower vehicle insurance costs.

Yet another advantage of the present invention is that it is easy to install. Still another advantage of the present invention is that it is structured to fit over a wide variety of types of seat belt buckles.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
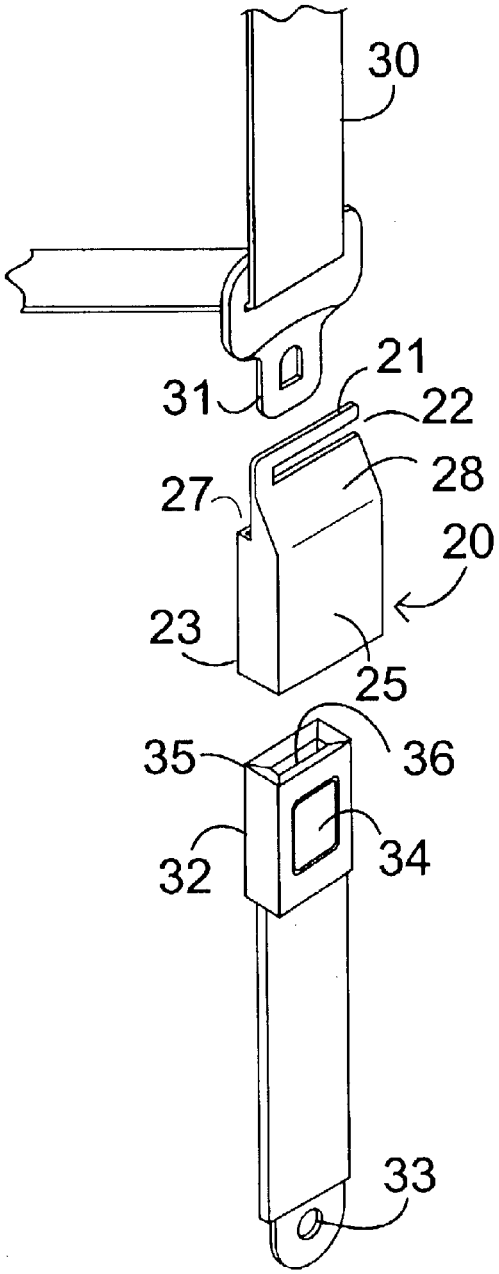
FIG. 1 is an exploded perspective view showing the seat belt buckle guard of the present invention aligned for mounting on a vehicle seat belt buckle with the prong of the buckle aligned for insertion through the guard and into the locking clasp receptacle portion of the buckle.
Figure 2:
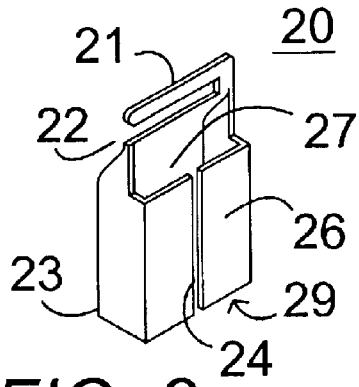
FIG. 2 is a perspective view of a back of the seat belt buckle guard of FIG. 1.
Figure 3:
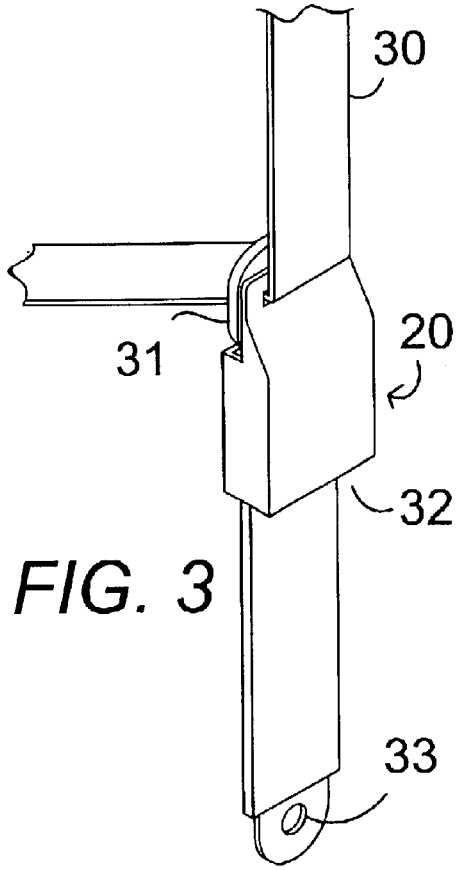
FIG. 3 is a perspective view of the seat belt buckle guard of FIG. 1 mounted over the seat belt buckle.

In FIGS. 1–3, a seat belt buckle guard device 20 is provided for preventing access to a release button 34 on a seat belt buckle with a receiving receptacle end 32 attached at an attaching point 33 and an insertion end 31 attached to a seat belt strap 30. The device 20 comprises a sleeve 23 structured to fit over a variety of shapes and sizes of seat belt buckles. The sleeve 23 comprises a front face 25 that is capable of covering a release button 34 of each of the variety of seat belt buckles. The sleeve 23 also comprises a top face 28 angled inwardly from the front face 25 at an acute angle to cover variously shaped top portions 35 of the variety of seat belt buckles thereunder. The front face 25 is formed of sufficiently rigid material to prevent indentation of the front face 25 and thereby prevent contact with a front seat belt buckle release button 34. The top face 28 is also formed of sufficiently rigid material to prevent indentation of the top face 28 and thereby prevent contact with a top seat belt buckle release button found on some seat belt buckles. The sleeve 23 further comprises a split 24 in the back face 26 that is connected to the front face 25 by two side faces. A back opening 27 is adjacent to the top of the sleeve 23, and is sufficiently large to accommodate variously sized insertion portions 31 of the variety of seat belt buckles positioned in the back opening 27. The split back face 26 enables the sleeve 23 to expand to fit over the variety of seat belt buckles, as shown in FIG. 3. The sleeve 23 further comprises a bottom opening 29 that is capable of fitting over a receiving end 32 of the seat belt buckle.

The sleeve 23 further includes a top arm 21 that extends from the sleeve 23. The top arm 21 is capable of fitting between an insertion portion of the seat belt buckle 31 and a seat belt strap 30 attached to the insertion portion 31. The top arm 21 is also capable of being lodged between the insertion portion 31 and the seat belt strap 30 to secure the sleeve 23 in place. The arm 21 comprises a hook extending from a side of a top end of the sleeve 23 and spaced apart by a slot 22 from the sleeve 23 a sufficient distance to accommodate a seat belt strap 30 between the arm 21 and the sleeve 23. The arm 21 is sufficiently thick to fit between the insertion portion of the seat belt buckle 31 and the seat belt strap 30 with a tight friction fit.

In practice, the user would hook the hook 21 over the seat belt strap 30 between the insertion portion 31 and the strap. The user would then slide the sleeve 23 over the receptacle portion 32 and insert the insertion portion 31 in the top opening 36 of the receptacle portion, thereby covering the release button 34 with the sleeve 23, as shown in FIG. 3.

To loosen the buckle, the user would then pull the seat belt strap 30 forward, away from the arm 21, releasing the friction fit tension and sliding the sleeve 23 in an upward motion, thereby exposing the seat belt release button 34.

It is understood that the preceding description is given merely by way of illustration and not in limitation of the invention and that various modifications may be made thereto without departing from the spirit of the invention as claimed.

What is claimed is:

1. A seat belt buckle guard device for preventing access to a release button on a seat belt buckle the seat belt buckle having a receiving end and an insertion end attached to a seat belt strap, the device comprising:

a sleeve structured to fit over a variety of shapes and sizes of seat belt buckles, the sleeve comprising a front face capable of covering a front portion of each of the variety of seat belt buckles, a top face angled inwardly from the front face, the top face capable of covering a top portion of each of the variety of seat belt buckles, the front face formed of sufficiently rigid material to prevent indentation of the front face and thereby prevent contact with a front seat belt buckle release button and the top face formed of sufficiently rigid material to prevent indentation of the top face and thereby prevent contact with a top seat belt buckle release button, the sleeve further comprising a split back face connected to the front face by two side faces, the split back face enabling the sleeve to expand to fit over the variety of seat belt buckles, the sleeve further comprising a bottom opening capable of fitting over a receiving end of the seat belt buckle, and the sleeve further comprising a top arm extending from the sleeve, the top arm being capable of fitting between an insertion portion of the seat belt buckle and a seat belt strap attached to the insertion portion, the top arm capable of being lodged between the insertion portion and the seat belt strap to secure the sleeve in place, the arm comprising a hook extending from a side of a top end of the sleeve and spaced apart from the sleeve a sufficient distance to accommodate a seat belt strap between the arm and the sleeve.

2. The device of claim 1 wherein the top face of the sleeve is angled inwardly from the front face at an acute angle to cover variously shaped tops of the variety of seat belt buckles thereunder.

3. The device of claim 1 wherein the arm is sufficiently thick to fit between the insertion portion of the seat belt buckle and the seat belt strap with a tight friction fit.

4. The device of claim 3, wherein the arm has at least one arm portion capable of engaging a slot in the insertion portion of the seat belt buckle through which slot the seat belt strap is engaged.

5. The device of claim 1 wherein the sleeve is provided with a back opening adjacent to a top of the sleeve, the back opening sufficiently large to accommodate variously sized insertion portions of the variety of seat belt buckles positioned in the back opening.

* * * * *